United States Patent [19]

Straslicka et al.

[11] 3,930,751

[45] Jan. 6, 1976

[54] BUCKET LOCKING MECHANISM

[75] Inventors: William A. Straslicka, Norvelt; Arthur J. Miller, Irwin, both of Pa.

[73] Assignee: Carrier Corporation, Syracuse, N.Y.

[22] Filed: July 5, 1974

[21] Appl. No.: 485,867

[52] U.S. Cl. ..... 416/220; 416/193 A; 416/500

[51] Int. Cl.[2] ..... F01D 5/32

[58] Field of Search ..... 416/220, 219, 221, 500, 416/193 A

[56] References Cited

UNITED STATES PATENTS

| | | | |
|---|---|---|---|
| 2,867,408 | 1/1959 | Kolb et al. | 416/220 |
| 3,088,708 | 5/1963 | Feinberg | 416/215 |
| 3,198,485 | 8/1965 | Melenchuk | 416/220 |

*Primary Examiner*—Everette A. Powell, Jr.
*Attorney, Agent, or Firm*—J. Raymond Curtin; Thomas J. Wall

[57] ABSTRACT

A locking mechanism for preventing axial movement of side entry buckets mounted upon a rotor disc. The locking mechanism includes a pin loosely supported within a disc tang, the pin having a recessed shoulder arranged to abut against the platform of a first bucket and an extended section arranged to be received in a complementary slot formed in the platform of the next adjacent bucket. A further mechanism is provided for preloading the pin against the buckets whereby the dampening characteristics of the system are enhanced and balancing of the buckets is facilitated.

4 Claims, 4 Drawing Figures

BUCKET LOCKING MECHANISM

BACKGROUND OF THE INVENTION

This invention relates to apparatus for holding a series of buckets to a rotary disc and, in particular, to a locking mechanism for preventing axial shifting of buckets slidably mounted upon a rotary support disc.

In many typical rotary machine structures, the rotating blades are supported within a disc by inserting the blade roots into complementary slots formed in the disc structure. In order to secure these side entry blades against axial movement in assembly, it has been the general practice to either peen the blade structure over the disc or dowel the blade roots into the support disc. These operations, however, involve a great deal of hand machining and are thus time consuming and costly to carry out. Similarly, once the blade is assembled, removal of the blade for replacement or repair becomes extremely difficult. Furthermore, the dampening characteristics of these prior art devices have generally been poor and balancing of the assembled structure difficult to obtain.

SUMMARY OF THE INVENTION

It is therefore an object of the present invention to improve apparatus for locking a side entry bucket blade to a support disc.

Another object of the present invention is to improve the dampening characteristics of rotary blade structures utilizing side entry blades.

A further object of the present invention is to simplify the locking means for preventing axial movement of a side entry blade in respect to the support disc.

Yet another object of the present invention is to provide a removable blade locking mechanism for facilitating replacement of side entry blades from a support disc.

These and other objects of the present invention are attained by means of a blade assembly including a rotary support disc having a plurality of axial openings for receiving in sliding relationship therein complementary roots of a bucket series, each bucket in the series having an extended platform arranged to span across the outer periphery of the support disc with the side walls of each platform being positioned in close proximity and adjacent to the side wall of an adjacent bucket platform, a locking pin loosely supported within a hole formed in the outer periphery of the support disc between the adjacent side walls of the bucket platforms, the pin having a recessed shoulder extending beneath one of the adjacent platforms to prevent the pin from moving out of the hole and an extended section passing upwardly into an aperture in the other adjacent platform to prevent the bucket from moving axially out of the support disc opening.

BRIEF DESCRIPTION OF THE DRAWINGS

For a better understanding of the invention as well as other objects and further features thereof, reference is had to the following detailed description of the invention to be read in connection with the accompanying drawings, wherein.

DESCRIPTION OF THE PREFERRED EMBODIMENT

Figure 1:
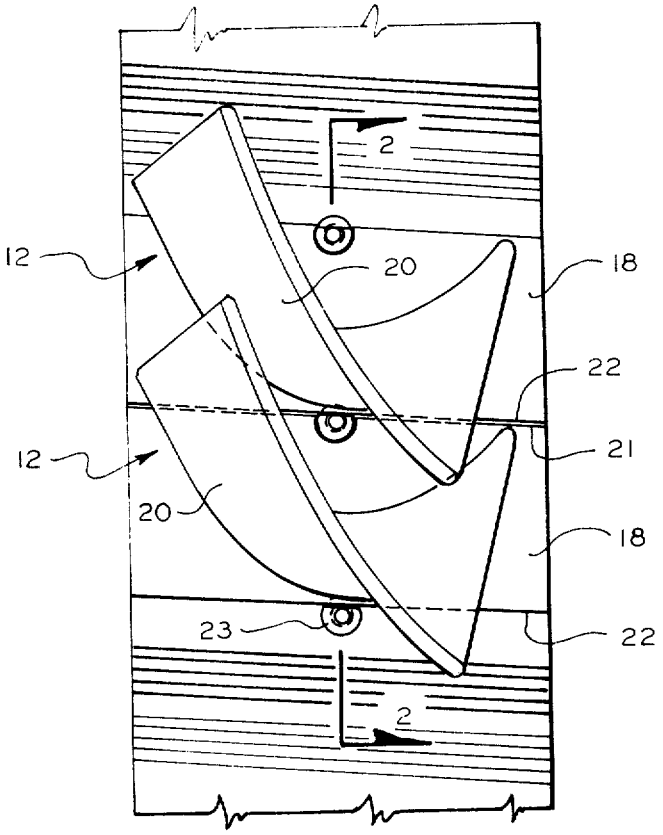
FIG. 1 is a partial plan view of a bucket and disc assembly employing the locking mechanism of the present invention.
Figure 2:
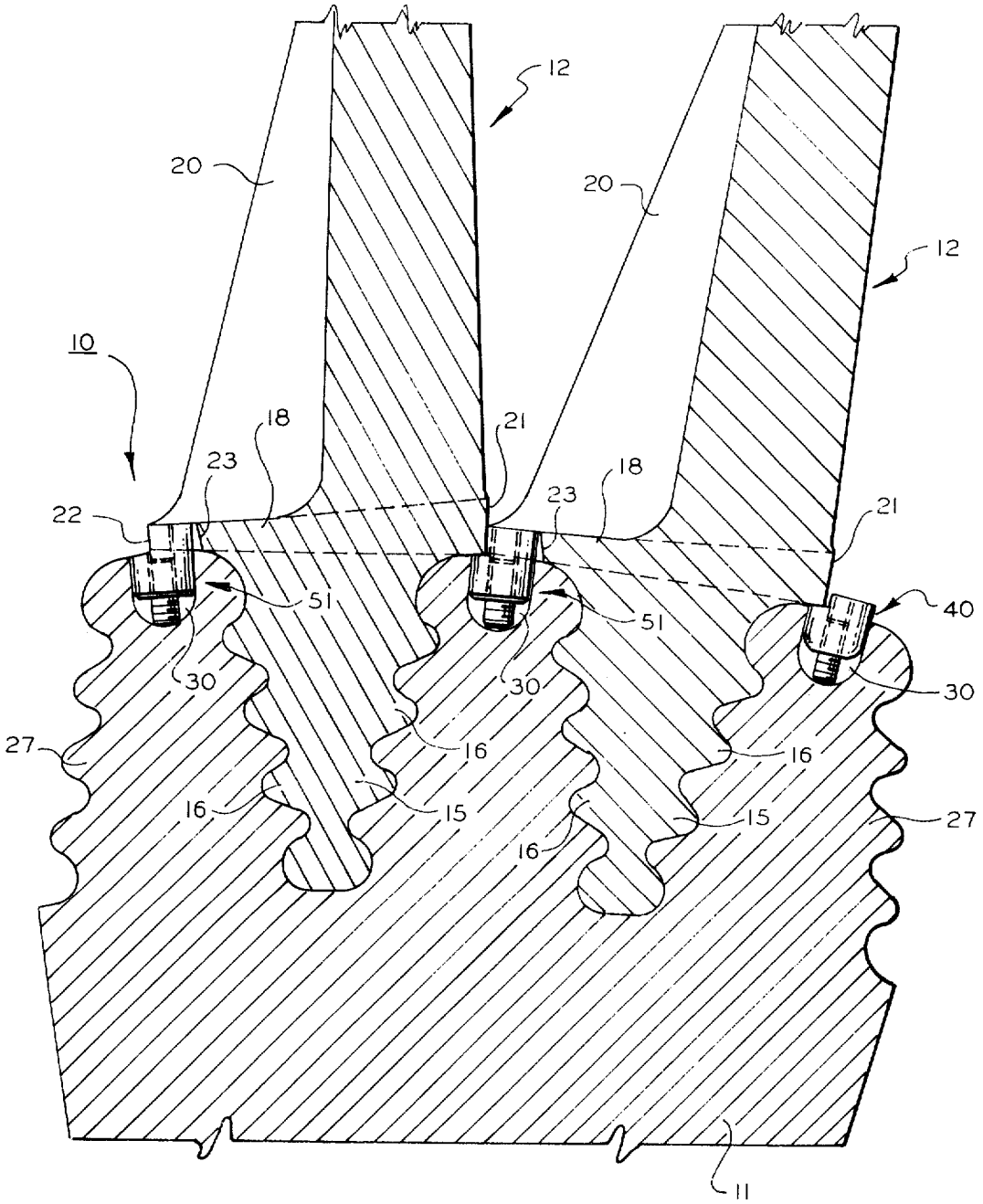
FIG. 2 is an enlarged sectional view taken along lines 2—2 in FIG. 1.

Referring first to FIG. 2, there is illustrated a blade and disc assembly, generally referenced 10, including a rotary support disc 11 and a series of radially extended buckets 12, supported therein. The assembly herein described is of the type generally employed in turbo machinery, however, it should be clear that the mechanism embodied in the present invention is not necessarily limited to this particular usage, and the invention is contemplated as having broader application. The root 15 of each bucket in the series is generally triangular in cross-sectional form and contains a series of outwardly extended projections 16 describing what is generally referred to as a "double dove tail" or "fir tree" configuration. The support disc is provided with a series of slots or grooves complementing the fir tree configuration of the bucket roots by which each blade is slidably received thereon. In assembly, the blade roots are slidably mounted within the disc slots and the blades moved axially into an operative position as shown in FIG. 1. This type of mounting arrangement is commonly referred to as "side entry blading," and this term shall be used herein in this regard.

The individual buckets are comprised of the heretofore mentioned root section 15, a longitudinally extended platform 18, generally arranged to overly the outer periphery of the disc, and a radially extended air foil 20. As more clearly seen in FIG. 1, the axially extended side walls 21, 22 of each bucket platform are orientated to span across the disc substantially parallel to the axis thereof. In assembly, one side wall of a bucket in the series is positioned adjacent to that of the next adjacent bucket. One side wall 21 of each platform describes a continuous or unbroken planar radial surface, while the opposing side wall 22 contains a centrally located slotted hole 23 formed therein. The slotted hole, as shown in the present embodiment, is arcuate in form, however, any desired shape can be similarly employed without departing from the teachings of the present invention.

In assembly, the adjacent side walls 21, 22 of adjoining bucket platforms span across a raised tang 27 located between the blade receiving side entry grooves in the disc. A radially extending hole 30 is machined or otherwise formed in each tang. The tang hole is positioned so that it can be axially aligned with the arcuate-shaped slot 23 formed in the overlying platform when the blades are mounted in an operative position upon the disc. The buckets are assembled so that the continuous planar side wall 21 of the one bucket platform faces the slotted side wall 22 of the next subsequent bucket platform. As a result, the platform of the first adjacent bucket partially covers the tang hole, while the slotted hole in the adjacent platform cooperates with the hole to provide a passage extending through the platform into the tang structure.

Figure 3:
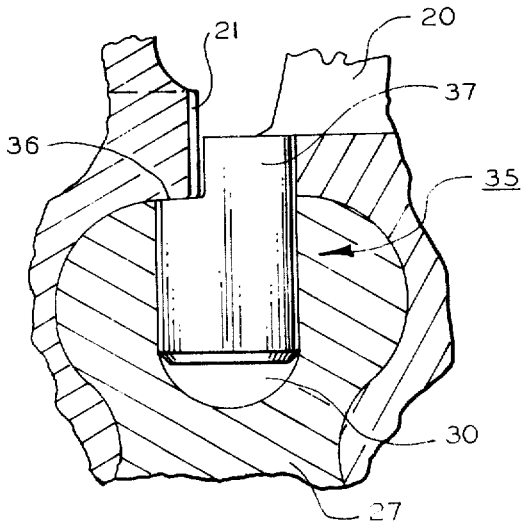
FIG. 3 is an enlarged view of a locking mechanism embodying the teachings of the present invention.

A locking pin is bottomed in each of the tang holes. The pin 35, as illustrated in FIG. 3, has a recessed shoulder 36 formed therein, arranged to extend beneath the bottom surface of one adjacent platform describing the continuous side wall thereof. The pin is also provided with an elongated section 37 arranged to pass outwardly from the tang hole into the slotted hole formed in the adjacent blade platform. A close running or sliding fit is maintained between the extended pin section and the slotted hole which limits the axial movement of the bucket within the rotor structure to prevent the bucket from shifting out of its assembled position. The axial length of the pin is such that the end of the extended section lies substantially parallel with the upper surface of the platform.

In the particular arrangement shown in FIG. 3, the locking pin is prevented from moving radially out of the tang hole by one of the adjoining platforms while the extended section of the pin passes upwardly into the next bucket platform and prevents the blade from shifting axially in assembly. As can be seen, each bucket is thus adapted to support one pin in the series in a bottomed position and to receive in close sliding relationship the raised portion of the next subsequent pin. As a result, when the circumferentially arranged series of buckets are all mounted upon the disc, each of the buckets will be locked in place by one of the locking pins.

Figure 4:
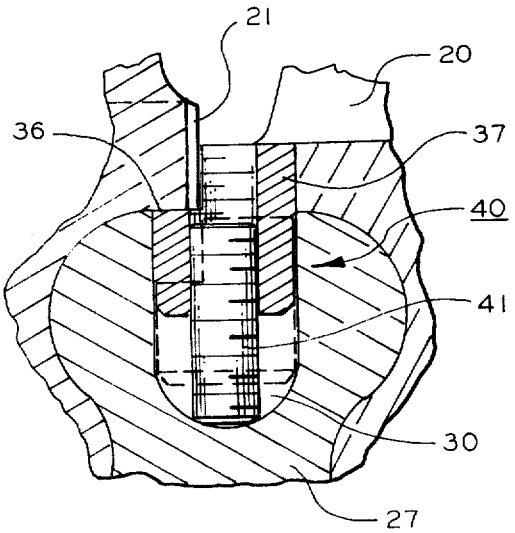
FIG. 4 is a second enlarged view illustrating a locking mechanism for securing the last bucket in the assembly shown in FIG. 1.

To facilitate assembly between the first bucket and the last bucket mounted on the disc, the platforms of which will be adjacent to each other in final assembly, a short pin 40, as illustrated in FIG. 4, is herein provided. In practice, the short pin is structurally similar to that of the longer pin 35, except that the bottom portion of the pin is cut away to the extent that the extended section of the pin is recessible into the tang hole to permit the bucket platform to pass thereover. The retracted position of the short pin is shown by the dotted lines in FIG. 4. A threaded hole, extending axially through the pin, is adapted to receive a set screw 41, the length of which is equal to or slightly less than the axial length of the pin.

The first step in assembling the buckets to the disc is to insert a short pin and set screw assembly into a first tang hole with the pin in a recessed position. The first bucket in the series is then moved into place with the unbroken side wall 21 of the platform positioned over the recessed pin. A first longer locking pin 35 is then inserted in the tang hole with the extended portion of the pin being seated in the slotted hole carried by the opposite side wall of the first bucket platform. The root of the next subsequent bucket in series is then slidably received in the support disc with the unbroken platform of the second bucket being placed over the shoulder of the first long pin, thus locking the pin in position. This series of operations is repeated until the last bucket is mounted upon the disc. At this time, the short pin is screwed upwardly, by turning the set screw, until the extended section of the short pin is positioned within the slot of the last bucket platform thereby closing the assembly. The metal of the set screw in the short pin is then preferably upset to prevent it from becoming loosened or withdrawn from the assembly when exposed to vibrations.

In the present assembly, each bucket in the series is secured to the rotor structure in a relatively loose arrangement so that the vibration dampening characteristics of the system are enhanced over assemblies requiring a more positive or secure binder between the cooperating elements. The dampening characteristics of the system can be further facilitated by providing each of the locking pins with an axial aligned set screw as herein described with reference to the short pin. This particular embodiment is illustrated in FIG. 2, where both the short pin assembly 40 and the longer pin assemblies 51 are shown with a set screw acting against the bottom of the tang holes. In this arrangement, the individual locking pins are raised upwardly by the screws to position the pin shoulders in abutting contact against the bottom of the overlying bucket platforms. The load exerted by the pin against the bucket can be adjusted to fine tune the buckets to avoid resonance, thus further enhancing the dampening properties of the system.

Preloading each pin against one of the buckets in the series has the further advantage of providing a means by which the assembly can be balanced in a relatively simple manner. The loosely fitted buckets can be repositioned slightly under the influence of the locking pin assembly by adjusting the pin position via the set screw. As can be seen, by use of the pin and set screw arrangement, any imbalance in the system can be offset or compensated for.

While this invention has been described with reference to the structure herein disclosed, it is not confined to the details as set forth, and this application is intended to cover any modifications or changes as may come within the scope of the following claims.

What is claimed is:

1. In a rotor assembly of the type wherein a series of side entry blades are mounted upon a rotor disc by sliding the blade roots into complementary grooves formed within the disc, each blade further having a platform overlying the tang formed in the disc between each root receiving groove, the side edges of each platform being in close proximity with that of the next adjacent blade platform, the improvement comprising a radially extending hole formed in each tang, the hole being formed so that it is substantially centered between adjacent blade platforms with the hole extending beneath each of said adjacent platforms, a locking pin having a close sliding fit with said holes being mounted within each hole, said pin having a shoulder being arranged to pass beneath one of said adjacent platforms and an extended section passing outwardly from said hole and being slidably received within a complementary groove formed in the other of said adjacent platforms, and screw means operatively associated with each of said pins for raising the pin within said hole to lock the shoulder of said pin against said one adjacent platform whereby the damping characteristics and balance of each blade is adjustable.

2. The assembly of claim 1 wherein one of said pins is of a length substantially equal to or less than the depth of the hole whereby the platform of the last mounted blade upon said disc is able to pass over the pin when said pin is recessed within the hole and said pin is capable of being raised into a locking position when said last blade platform is positioned upon said disc.

3. The assembly of claim 2 wherein said screw means comprises a set screw threadably passing through the axis of said pin and being arranged to seat against the bottom of said hole.

4. The assembly of claim 1 wherein said hole is of a circular cross section of a substantially greater diameter than the space between each adjacent blade.

* * * * *